US005965988A

United States Patent [19]

Vollkommer et al.

[11] Patent Number: 5,965,988

[45] Date of Patent: Oct. 12, 1999

[54] DISCHARGE LAMP WITH GALVANIC AND DIELECTRIC ELECTRODES AND METHOD

[75] Inventors: Frank Vollkommer, Buchendorf; Lothar Hitzschke; Klaus Stockwald, both of Munich, all of Germany

[73] Assignee: Patent-Treuhand-Gesellschaft fur elektrische Gluehlampen mbH, Munich, Germany

[21] Appl. No.: 08/945,851

[22] PCT Filed: May 3, 1996

[86] PCT No.: PCT/DE96/00779

§ 371 Date: Nov. 7, 1997

§ 102(e) Date: Nov. 7, 1997

[87] PCT Pub. No.: WO96/36066

PCT Pub. Date: Nov. 14, 1996

[30] Foreign Application Priority Data

May 12, 1995 [DE] Germany ..... 195 17 515

[51] Int. Cl.[6] ..... H05B 41/00

[52] U.S. Cl. ..... 315/246; 315/260; 313/497; 313/607

[58] Field of Search ..... 315/39, 246, 260, 315/224, DIG. 5; 313/607, 497, 493, 631

[56] References Cited

U.S. PATENT DOCUMENTS

| | | | |
|---|---|---|---|
| 4,260,932 | 4/1981 | Johnson | 315/205 |
| 4,427,920 | 1/1984 | Proud et al. | 315/39 |
| 5,028,847 | 7/1991 | Greb et al. | 315/248 |
| 5,367,226 | 11/1994 | Ukegawa et al. | 315/248 |
| 5,604,410 | 2/1997 | Vollkommer et al. | 315/246 |

FOREIGN PATENT DOCUMENTS

| | | |
|---|---|---|
| 0550047 | 7/1993 | European Pat. Off. . |
| 0700074 | 3/1996 | European Pat. Off. . |
| 89-04539 | 8/1989 | Germany . |
| 4311197 | 10/1994 | Germany . |
| 94-23442 | 10/1994 | WIPO . |

*Primary Examiner*—Don Wong
*Assistant Examiner*—Wilson Lee
*Attorney, Agent, or Firm*—William E. Meyer

[57] ABSTRACT

A discharge lamp may be formed with both galvanic and dielectric electrodes. The relative discharges due to the currents between the differing electrodes may be adjusted to effect the optical spectrum of the radiation emitted by the lamp.

25 Claims, 3 Drawing Sheets

DISCHARGE LAMP WITH GALVANIC AND DIELECTRIC ELECTRODES AND METHOD

FIELD OF THE INVENTION

The invention concerns electric lamps and in particular electric discharge lamps. More in particular the invention concerns an electric discharge lamp and a method of operating the lamp having both galvanic and dielectric electrodes.

DESCRIPTION OF THE RELATED ART

From DE-U-89 04 853 an AC powered fluorescent lamp is already known. Inside the discharge chamber of the lamp are two spiral-shaped incandescent electrodes and one metallic element which is separated from the interior of the discharge chamber by a dielectric. A discharge is generated in the discharge chamber by the heated spiral-shaped electrodes. In addition, a voltage is applied to the metallic element during operation. In this manner the metallic element functions as a condenser plate for the discharge so that the electrical resistance of the discharge plasma is increased, alheit localized all the more, the more current density is applied. The object is to spatially homogenize the lamp current and therefore the brightness of the lamp with assistance from the condenser plate and to increase the effectiveness of the lamp.

In EP-A-0 550 047 an AC-powered flat fluorescent lamp was shown which has a discharge chamber constructed of planar plates. On the interior of the plates a pair of planar electrodes are arranged, which are coated with dielectric glass layers. Additionally the lamp has a pair of galvanic electrodes in its interior. Both pairs of electrodes are operated with a high frequency of either differing or identical frequency, in the second case out of phase with each other by 90°. The planar electrodes create capacitatively a plasma which is stable and spatially uniform. The galvanic electrodes create a low pressure discharge with a high light output which is, however, spatially nonuniform. Both discharges supplement each other to create a planar light source of high brightness and uniformity.

Therefore, and because of its flat shape, the lamp is particularly suited for use in the rear illumination of liquid crystal displays.

From EP-A 700 074 a longish lamp with a tubular discharge chamber which is hermetically sealed on both ends and is filled with neon gas is known. The interior surface of the discharge chamber is optionally coated with a phosphor coating, specifically $Y_3Al_5O_{12}$:Ce. The interior of the discharge chamber has two opposing unheated electrodes connected to electrical leads.

The lamp can be operated by the two following methods:

1. A sine wave type alternating voltage, i.e. with a frequency of 60 Hz, serves to generate a discharge in the discharge chamber whereby electromagnetic radiation, primarily in the red and infrared regions of the spectrum with low VUV and UV proportions, is emitted. In this operating method the lamp emits mostly a red light and is therefore suited, for example, for use in automobile brake lights. In this case a phosphor coating is not used.
2. A pulse voltage, e.g. with a frequency of 12 Hz and usual pulse length in $\mu$s range, serves to generate a discharge in the discharge chamber whereby electromagnetic radiation is likewise emitted in the red and infrared regions of the spectrum, but clearly with a higher VUV and UV proportion in contrast to operating method number 1. The VUV and UV radiation excites the $Y_3Al_5O_{12}$:Ce phosphor, which fluoresces in the yellow spectrum (mid wavelength: 556 nm, full width at half maximum (FWHM): 103 nm). Therefore, in this operating method the lamp emits primarily a yellow light and is suited, for example, for use in automobile turn-signal lamps.

In the case of the pulse operation of the lamp, a sequence of voltage pulses is applied to the lead-in wires which extend through the ends of the discharge chamber to the exterior. The voltage pulses are separated from each other by relatively long pauses (low duty cycle). The pause durations are necessary for the determination of the desired color locus of the lamp.

Since ionization quickly decreases during the pulse pauses, relatively high pulse voltages are needed to reignite the discharge, particularly in the case of long lamps which have a great distance between the electrodes. Higher pulse voltages, however, lead to increased electromagnetic interference radiation that is emitted by the lamp and the operating circuit. This can affect electronic circuitry (EMI= Electromagnetic Interference). To prevent this, especially in an environment where safety is a concern, such as automotive engineering, an effective shielding is required. From the high pulse voltages of operating method #2 a second drawback results. For suitable equipment, heavier duty, and therefore more expensive, parts are required.

BRIEF SUMMARY OF THE INVENTION

A discharge lamp may be formed with a sealed discharge chamber containing an ionizable filling and having in its interior two opposing, unheated galvanic electrodes connected by electrical leads that extend in a gas tight manner through the discharge chamber to the exterior, and the discharge chamber is additionally equipped with at least one dielectric electrode.

An object of the invention is to present a method for pulse operation of discharge lamps by which the spectral distribution of the radiation emitted from the discharge lamp can be precisely influenced and the required level of the voltage pulses, in comparison to conventional methods, can be lowered.

This object is reached in accordance with the invention by the characterizing features of claim 1. Further advantageous features are presented in the respective sub-claims.

A further object of the invention is to offer a discharge lamp which is suited for operation under the specified method according to the invention.

This object is reached according to the invention by the characterizing features of claim 10. Further advantageous features are presented in the respective sub-claims.

DETAILED DESCRIPTION OF THE INVENTION

Figure 1:
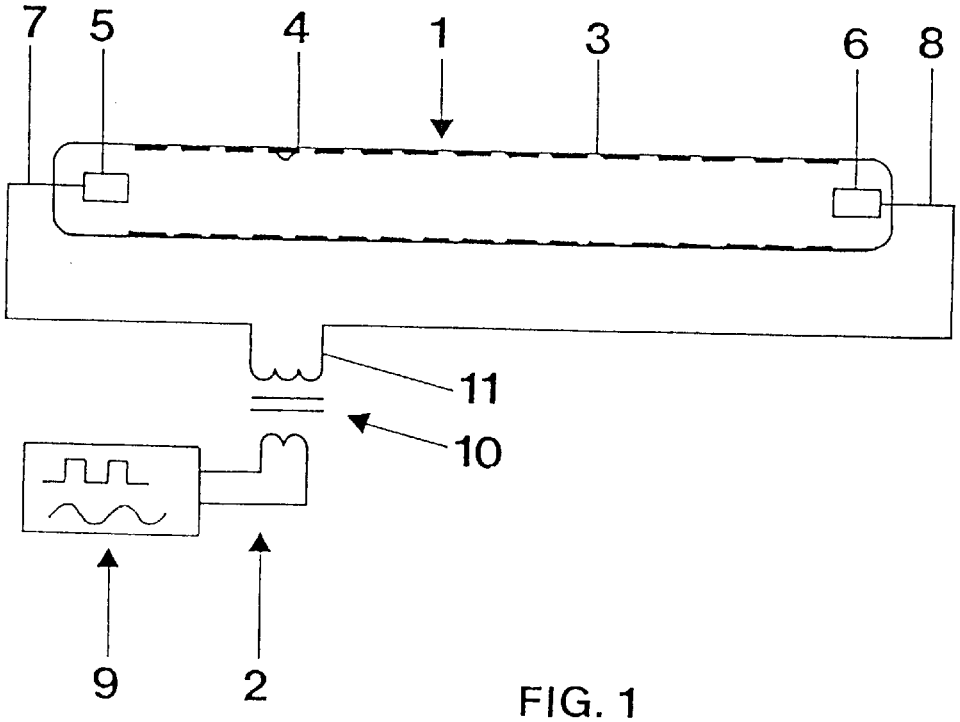
FIG. 1 Shows a tube shaped fluorescent lamp with galvanic electrodes according to the prior art as well as an operating apparatus for the operation of the lamp.

The main concept of the invention concerns the production of a dielectrically impeded discharge in the discharge chamber in addition to the conventional pulsed discharge between the lamp electrodes in a discharge lamp. By this measure the spectral distribution of the radiation emitted from the discharge lamp can be precisely influenced and the required level of the voltage pulses, in comparison to conventional methods, can be lowered.

Dielectrically impeded discharges differ from conventional (un-impeded) discharges in that either one electrode (single-sided dielectrically impeded discharge) or both electrodes (double-sided dielectrically impeded discharge) is/are separated from the discharge by a dielectric layer. In this case the dielectric layer can take the form of an at least partial enveloping of at least one electrode. Likewise the dielectric layer can be formed by the wall of the discharge chamber itself, if the electrode(s) is/are arranged outside the discharge chamber, for instance, on the surface thereof. For simplicity's sake, such electrodes will be referred to hereinafter as "dielectric electrodes". For differentiation, electrodes which immediately border on the discharge, that is, without a dielectric separation layer, will be referred to hereinafter as "galvanic electrodes".

The method in accordance with the invention provides—in addition to the sequence of voltage pulses required for the generation of the dielectrically un-impeded pulsed discharge—the use of a time-variable voltage to generate the dielectrically impeded discharge. As time-variable voltages, for example, alternating voltages and particularly a sequence of voltage pulses are suitable, whereby the individual voltage pulses are separated by pauses respectively.

In principle, multiple pulse forms, for example, triangular and square wave shapes, are suitable for the voltage pulses, both for the generation of the un-impeded as well as the dielectrically impeded discharge. The pulse width is typically between 0.1 $\mu$s and 50 $\mu$s. For efficient radiation generation it is necessary that the pulses be separated by pauses. Typical pulse-pause ratios are within 0.001 and 0.1. The pulse sequences described in WO 94/23442 are especially suited for this application.

The optical spectrum of the radiation emitted by the lamp can be influenced by the ratio of the average electrical powers coupled into the conventional (dielectrically un-impeded) as well as into the dielectrically impeded discharges. The reason for this lies in the differing particle kinetics of the two discharge types. Consequently, the spectral composition of the radiation emitted in each case is different. According to the ratio of the electric powers coupled in, the radiation proportions of the respective spectral components of both discharge types of the total radiation of the discharge lamp change and, consequently, so also the entire spectrum, thus the color locus.

The ratio of the powers is influenced by the pulse sequence(s), particularly the durations as well as the amplitudes of the pulses and the pauses and/or, optionally, the frequency of the alternating voltage, the configuration of the electrodes as well as the type and pressure of the lamp's filling. Typical ratios of the electric powers of un-impeded discharge to impeded discharge lie in a range between 0.01 and 100, preferably in a range between 0.5 and 10.

The influence of the color locus can also be supported by the use of a suitable phosphor. For this the inner wall of the discharge chamber is provided with a phosphor coating which converts the UV and VUV radiation of the discharge into light.

The selection of the ionizable filling and, optionally, the phosphor coating is dependent on the end use of the lamp. Ideally suited for these purposes are the noble gases, e.g. neon, argon, krypton and xenon, as well as mixtures of noble gases. Of course, other fill substances can also be used, e.g. all substances which commonly find use in the generation of light, particularly Hg mixtures and noble gas-Hg mixtures as well as rare earths and their halides.

Un-impeded discharges cause a relatively wideband excitation of the atoms in the filling, that is, atomic states of different excitation levels are occupied. In the case of neon, for example, this excitation takes the form of radiation in the red region of the optical spectrum. In contrast to this, the use of a dielectrically impeded discharge and, in particular, the use of the pulsed dielectrically impeded discharge permits a selective coupling-in of energy in such a way that, for the most part, only the resonance level and few levels in the immediate vicinity of the resonance level are excited. From the atoms in metastable states there form, as a result of further collisions, very efficient short-lived, excited molecules, so called "excimers", in the case of neon, for example $Ne_2$. Molecular band radiation is generated during the decay of the excimers. Noble gas excimers emit in the UV and VUV spectral range. As an example, $Ne_2$ has a maximum intensity at approximately 85 nm. By phosphors such as $Y_3Al_5O_{12}$:Ce, this short-wave, invisible radiation can be converted into visible radiation, in the previous example a yellow light.

This effect is particularly clear with phosphors of high excitability in the excimer emission range. Through this a new, independent possibility for the determination of the color locus is opened.

In the case that the dielectrically impeded discharge is driven with pulses like the un-impeded discharge, the two pulse sequences will be synchronized to one another to provide a lamp operation that is uniform over time. In a simplified variant this is attained in that the same sequence of voltage pulses is used both for generating the dielectrically impeded as well as dielectrically un-impeded discharges.

In a preferred application of the method, the pulsed dielectrically impeded discharge is connected temporally in advance of the un-impeded discharge, in such a way that a sufficient amount of start electrons are made available for the un-impeded discharge. In this way the impeded discharge—in addition to the advantage of the independent adjustability of the spectral distribution of the emitted radiation—permits to lower the voltage required for the operation of the un-impeded discharge.

A permanent reduction of the required voltage pulses for the un-impeded discharge can be reached in that the voltage pulses applied to the dielectric electrodes in each case are temporally in advance of the voltage pulses applied to the galvanic electrodes. However, this requires either two sychronizable supply devices or a precise measure in order to temporally shift the two pulse sequences against one other in the desired fashion.

This drawback is avoided in a preferred variant of the method in that firstly, the same sequence of voltage pulses is used both for the generation of the dielectrically impeded as well as the un-impeded discharges. Secondly, the electrode configurations are specifically chosen so that the ignition voltage of the dielectrically impeded discharge is smaller than that of the un-impeded discharge. To fulfill the first condition, the respective current leads of a galvanic and a dielectric electrode are electrically connected to one another. The second requirement is a sufficiently short distance between the dielectrically impeded electrodes in comparison to the un-impeded electrodes. In tube-like discharge chambers with longitudinally arranged galvanic electrodes this is easily accomplished in that, for example, two electrodes are transversely arranged on the exterior wall of the chamber.

As a result of these measures, first a dielectrically impeded discharge sets in, which on the one hand generates UV and VUV radiation which efficiently excites phosphors, and on the other hand reduces the operating voltage of the un-impeded discharge.

The discharge lamp according to the invention, suitable for the operation under the aforementioned method according to the invention, in its simplest application, exhibits only a single additional third electrode other than the two existing galvanic electrodes. A first one of the two galvanic electrodes in this case assumes two functions. On the one hand it serves, as customary, together with the second galvanic electrode, to generate the conventional un-impeded discharge. Secondly, it serves, together with the additional third electrode, to generate a single-sided dielectrically impeded discharge. For this purpose, the third electrode must necessarily be a dielectrically electrode. Additionally, and according to the teachings in WO 94/23442, it is advantageously connected with anode potential in respect to the corresponding un-impeded counterelectrode.

If a most symmetrical brightness distribution from the lamp and, therefore, also symmetrical discharge conditions inside the discharge chamber are desired, an additional fourth electrode is advantageous. The fourth, dielectric electrode then serves together with the third, also dielectric, electrode to generate a dual-sided dielectrically impeded discharge. A further advantage of the arrangement with two dielectric and two galvanic electrodes exists in the capability that the average powers coupled in for both discharges can be chosen independently of each other. From this results an even greater freedom in adjusting the spectral distribution and/or the color locus.

The shape of the dielectric electrodes is advantageously suited to the shape of the discharge chamber. Strip-like metal electrodes arranged along the longitudinal lamp axis are particularly suited with tube-like discharge chambers.

In a cost-effective application the dielectric electrode(s) is/are positioned on the exterior wall of the discharge chamber, for example, as applied metal strip(s) or as thin sprayed on, strip-type metallic coating(s). The advantage of this solution is that additional gas-tight lead-in wires as well as dielectric layers can be omitted. As a starting point, a conventional lamp can serve. In a more complex variant the metal strip(s) protrude(s) into the exterior wall of the discharge chamber and is/are imbedded or entirely encased in the wall of the discharge chamber. By these measures the metal strips are affixed to the discharge lamp. The drawback is an increased complexity in the manufacture and, therefore, higher costs.

In a variant of this application the dielectric electrodes are connected to one each of the leads of the galvanic electrodes. The advantage over separate electrode leads is that only one supply device is required for both discharges. On the other hand, a separate supply for the galvanic and the dielectric electrodes offers the capability to optimize the corresponding supply device to the specific requirements of the respective discharge types.

A metal strip tapering at one end is best suited in the case of a single dielectric electrode. The metal strip is advantageously connected to that galvanic electrode from which the tapering end points away. By this measure a nearly uniform, single-sided, dielectrically impeded discharge is guaranteed along the entire strip and in the direction of the corresponding galvanic counterelectrode.

In an application of the lamp for automobile engineering, a tube-shaped discharge chamber is filled with neon having a filling pressure in a range between 1 kPa and 200 kPa, preferably between 5 kPa and 50 kPa. The interior wall of the discharge chamber is coated with a VUV excitable phosphor, for example, $Y_3Al_5O_{12}$:Ce. The galvanic electrodes are two opposing electrodes, specifically cold cathodes, which are arranged in the interior of the discharge chamber. On the exterior wall of the discharge chamber at least one metallic electrode, specifically, at least one metal strip is applied as a dielectric electrode. In operation in accordance with the method of the invention, the lamp lights yellow and serves as a turn signal lamp.

In FIG. 1 a tube-shaped fluorescent lamp 1 according to the prior art as well as a ballast 2 for the operation of the lamp is schematically depicted. The fluorescent lamp 1 consists of a circular cylindrical discharge chamber 3 closed on both ends, the interior wall of which is coated with a phosphor coating 4 of $Y_3Al_5O_{12}$:Ce, as well as two metallic electrodes 5, 6 ("galvanic electrodes") located in the interior of the discharge chamber 3. The length of the discharge chamber 3 of hard glass is approximately 315 mm, the interior diameter approximately 3 mm and the thickness of the chamber wall approximately 1 mm. Inside the discharge chamber 3 is neon at a filling pressure of approximately 13.3 kPa. The two cup-shaped electrodes 5, 6 are oriented in the direction of the lamp's longitudinal axis and are located 305 mm from each other. The electrodes 5, 6 respectively are each connected with a lead 7, 8 which protrude out of the ends of the discharge chamber 3 in gas-tight manner. The ballast 2 consists of a generator 9 and a high voltage transformer 10. The secondary winding 11 of the high voltage transformer 10 is connected to the electrodes 5, 6 via the leads 7, 8.

In the following explanatory Figures similar reference numbers are applied to identical parts and are therefore not explicitly explained anew.

Figure 2:
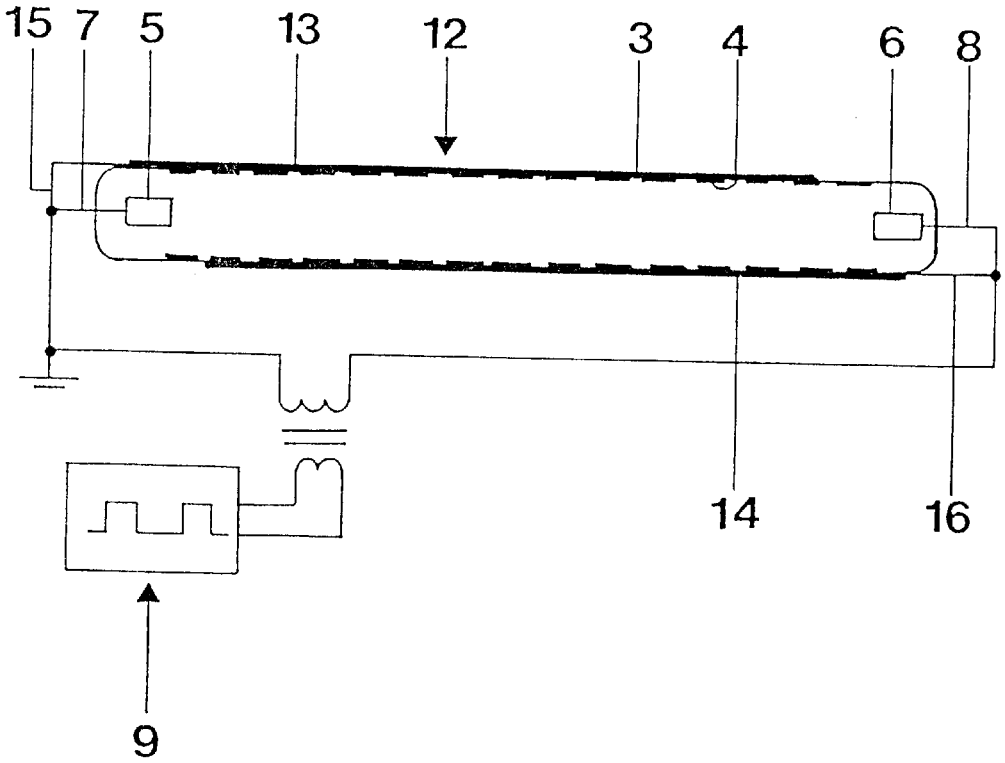
FIG. 2 Shows a tube shaped fluorescent lamp according to the invention with galvanic electrodes and two dielectric electrodes connected thereto.

FIG. 2 shows an application example of a tubular fluorescent lamp schematically depicted according to the invention. In comparison to the prior art in FIG. 1, the fluorescent lamp 12 in FIG. 2 has an additional two dielectric electrodes 13, 14. The respective dielectric electrodes 13, 14 are constructed of metal strips and are applied on the exterior wall of the discharge chamber 3 diametrically to each other and parallel to the longitudinal lamp axis. The width of the metal strips is approximately 2 mm. The metal strips 13, 14 are connected with lead-in wires 15, 16 which in turn are each connected with a lead 7 or 8 of the galvanic electrodes. The metal strips 13, 14 extend from the electrodes 5, 6 with which they are connected over a portion of the length of the discharge chamber 3. These measures insure sufficient distances between the metal strips 13, 14 and the galvanic electrodes 5, 6 with opposing potential. In this manner, undesired parasitic discharges between the metal strips 13, 14 and the galvanic electrodes 5, 6 are prevented. As desired, a double-sided dielectrically impeded discharge burns inside the discharge chamber 3 along the entire region in which the metal strips 13, 14 oppose each other. Consequently the phosphor coating 4 is excited to luminescence over almost the entire length of the discharge chamber 3.

Figure 3:
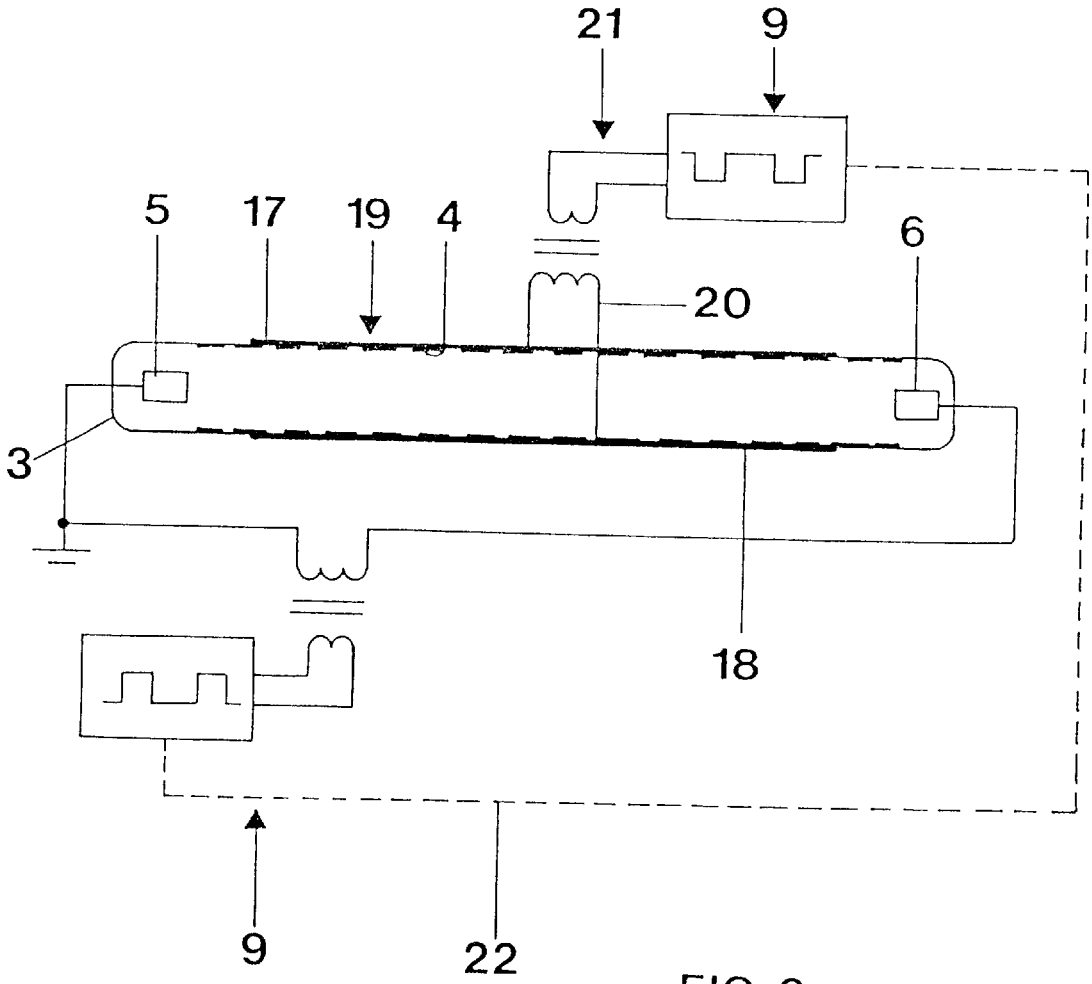
FIG. 3 Shows a tube shaped fluorescent lamp according to the invention with galvanic electrodes and two dielectric electrodes connected thereto with the galvanic and dielectric electrodes separately supplied electrically.

In FIG. 3 a further application example of a tube-shaped fluorescent lamp according to the invention is schematically depicted. In contrast to the fluorescent lamp 12 in FIG. 2, in FIG. 3 the dielectric electrodes 17, 18 of the fluorescent lamp 19 are not connected to the galvanic electrodes 5, 6 but are connected with the secondary coil 20 of an additional ballast 21. The ballast 21 for the dielectric electrodes 17, 18 is synchronized with the ballast 2 for the galvanic electrodes 5, 6 via a wire 22 that carries the synchronizing signal.

Figure 4:
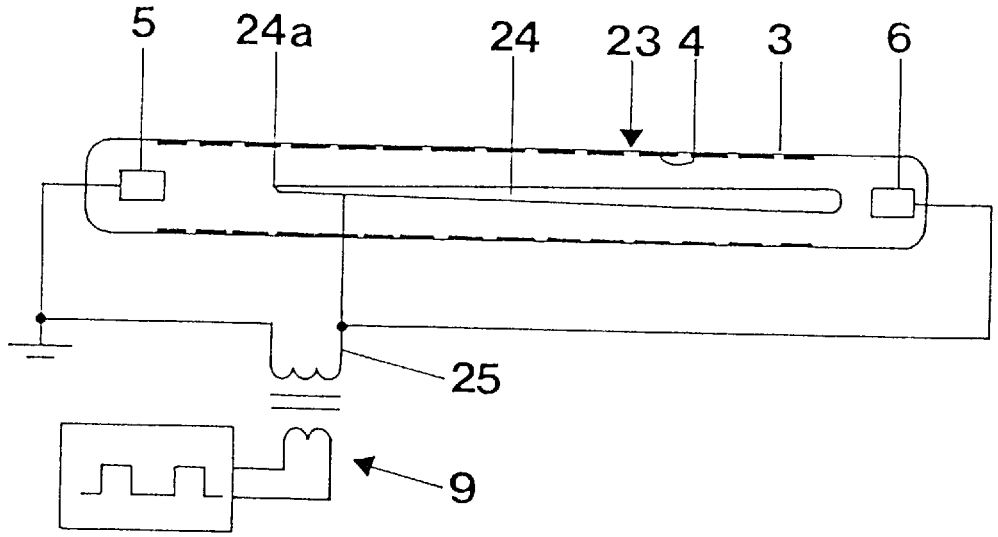
FIG. 4 Shows a tube shaped fluorescent lamp with galvanic electrodes according to the invention with a metal strip tapering on one side and functioning as the dielectric electrode.

FIG. 4 shows an application example of a tubular fluorescent lamp 23 according to the invention with only one dielectric electrode 24. The dielectric electrode 24 consists of a metal strip tapering on one side which is glued to the exterior wall of the discharge chamber 3. The trapeze-shaped metal strip 24 with rounded edges is connected along with the first galvanic electrode 6 to a pole of the secondary coil 11 of the high voltage transformer 2. The metal strip 24 is oriented parallel to the longitudinal axis of the lamp 23, whereby the tapering end 24*a* points away from the first galvanic electrode 6 and towards the second galvanic electrode 5, that is, the counterelectrode. The second galvanic electrode 5 is connected to the other pole of the secondary coil 25. In this manner, a single-sided, dielectrically impeded discharge burns, nearly uniformly distributed in longitudinal direction, between the metal strip 24 and the second galvanic electrode 5.

Figure 5:
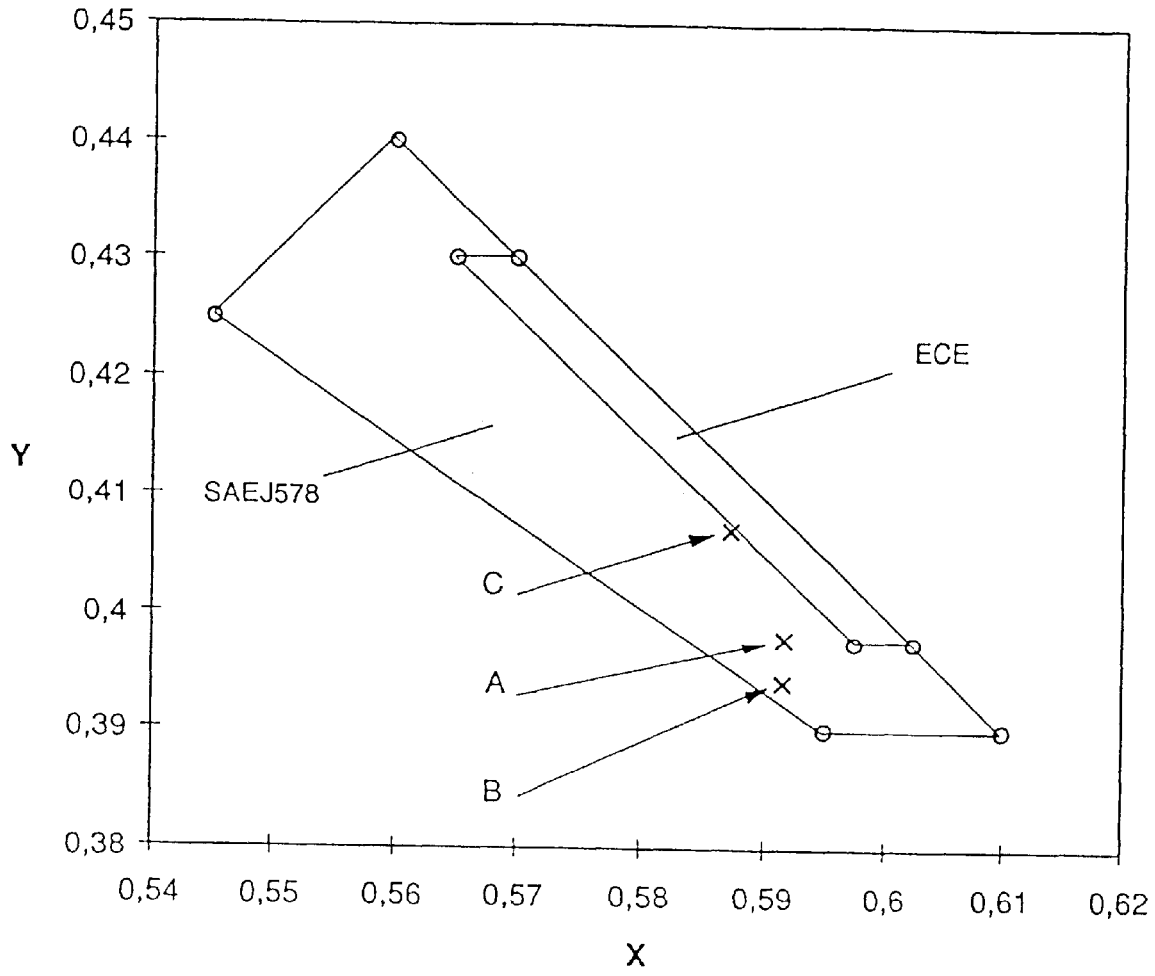
FIG. 5 Shows a chart comparing the color coordinates of the lamp from FIG. 4 under differing operating conditions.

The application of the invention as in the example of its usage as an automotive turn signal lamp is clear in FIG. 5 specifically in relation to the adjustability of the color locus and from the table pertaining to the reduction of the voltage pulses. In FIG. 5 the color coordinates of the lamp in FIG. 4 are displayed, measured during the operation according to the method of the invention (measuring point A), that is, with un-impeded and additionally with dielectrically impeded discharge. In comparison, measuring point B shows the color coordinates measured during the operation according to the conventional method, that is, only with un-impeded discharge. To realize the conventional method the lead-in wires 15, 16 of the two dielectric electrodes 13, 14 of the fluorescent lamp 12 were disconnected. Measuring point C marks the case of the purely dielectrically impeded discharge, whereby the leads 7, 8 of the two galvanic electrodes 5, 6 of the fluorescent lamp 12 are disconnected. In the examples presented the same ballast 9 is used for all three operating methods. The ballast 9 provides unipolar negative half-sine-like voltage pulses with pulse widths of approximately 1 $\mu$s and pause lengths of 50 $\mu$s. Additionally, the SAEJ578 and ECE coordinates are plotted, which show the requirements of the color locus for automotive turn signal lights for the US and European markets. It is easily seen how, by means of the invention, the color locus is intentionally shifted in the direction of the ECE color area. With equal power (40 W) coupled in approximately the same luminous flux (approximately 390 lm) is attained for measuring points A and B. At the same time a reduction of the required level of the voltage pulses from approximately 8.5 kV to 5.2 kV is achieved. As a result the necessity for shielding against electromagnetic interference radiation is greatly reduced. Further, the high voltage transformer and the switching elements of the ballast 9 can be made smaller, which offers certain cost benefits. For the purely dielectrically impeded discharge, only 10 W are coupled in at pulse voltages of approximately 6 kV and the luminous flux upon use of the phosphor $Y_3Al_5O_{12}$:Ce reaches 70 lm. The aforementioned values are displayed together in the following table for all three methods of operation.

TABLE

Comparison of a selection of operational data for the measuring points plotted in FIG. 5

| Measuring Point | A | B | C |
|---|---|---|---|
| Method of Operation | un-impeded + dielectrically impeded (as per the invention) | un-impeded (conventional) | dielectrically impeded |
| Pulse Level | 5.2 kV | 8.5 kV | 6 kV |
| Electrical Power | 40W | 40W | 10W |
| Luminous Flux | 391 lm | 390 lm | 70 lm |

The invention is not limited to the application examples shown. In particular, individual characteristics of different application examples can be combined with one another.

We claim:

1. Method for operating discharge lamps (12;19;23) with a discharge chamber (3) whereby a sequence of voltage pulses generates a dielectrically un-impeded pulsed discharge inside the discharge chamber (3), characterized in that additionally a dielectrically impeded discharge is generated inside the discharge chamber (3) and thereby the spectral distribution of the radiation emitted by the discharge lamp (12;19;23) is influenced and the level of the voltage pulses required for the dielectrically un-impeded pulsed discharge is reduced so that the required level is lower with additional, dielectrically impeded discharge than without additional dielectrically impeded discharge.

2. Method based on claim 1, characterized in that the dielectrically impeded discharge is generated by a sequence of voltage pulses, whereby the individual voltage pulses respectively are separated from each other by pauses.

3. Method based on claim 2, characterized in that the pulse widths lie in a range of 0.1 $\mu$s and 50 $\mu$s and that the pulse pause ratio lies in a range between 0.001 and 0.1.

4. Method for operating discharge lamps (12;19;23) with a discharge chamber (3) whereby a sequence of voltage pulses generates a dielectrically un-impeded pulsed discharge inside the discharge chamber (3), characterized in that additionally a dielectrically impeded discharge is generated inside the discharge chamber (3) and thereby the spectral distribution of the radiation emitted by the discharge lamp (12;19;23) is influenced and the level of the voltage pulses required for the dielectrically un-impeded pulsed discharge is reduced so that the required level is lower with additional, dielectrically impeded discharge than without additional dielectrically impeded discharge, the dielectrically impeded discharge being generated by a sequence of voltage pulses, whereby the individual voltage pulses respectively are separated from each other by pauses, the sequence of the voltage pulses for the generation of the un-impeded discharge being synchronized with the sequence of the voltage pulses for the generation of the dielectrically impeded discharge.

5. Method based on claim 4, characterized in that the sequence of voltage pulses for the generation of the dielectrically impeded discharge is connected temporally in advance of the sequence of the voltage pulses for the generation of the un-impeded discharge.

6. Method for operating discharge lamps (12;19;23) with a discharge chamber (3) whereby a sequence of voltage pulses generates a dielectrically un-impeded pulsed discharge inside the discharge chamber (3), characterized in that additionally a dielectrically impeded discharge is generated inside the discharge chamber (3) and thereby the spectral distribution of the radiation emitted by the discharge lamp (12;19;23) is influenced and the level of the voltage pulses required for the dielectrically un-impeded pulsed discharge is reduced so that the required level is lower with additional, dielectrically impeded discharge than without additional dielectrically impeded discharge, the dielectrically impeded discharge being generated by a sequence of voltage pulses, whereby the individual voltage pulses respectively are separated from each other by pauses, the same sequence of voltage pulses being used for the generation of the dielectrically impeded discharge as well as the dielectrically un-impeded discharge.

7. Method based on claim 1, characterized in that the ratio of the electrical powers coupled in for the un-impeded as well as impeded discharges lies within a range of 0.01 and 100.

8. Method based on claim 7, characterized in that the ratio is between 0.5 and 10.

9. Method based on claim 1, characterized in that the discharge chamber (3) is provided with a phosphor coating (4) in order to thereby support the influence on the spectral distribution of the radiation emitted by the discharge lamp (12;19;24) and the color locus of the discharge lamp (12;19;24).

10. Discharge lamp (12;19;23) suited for operation according to a method for operating said discharge lamps (12;19;23) with a discharge chamber (3) whereby a sequence of voltage pulses generates a dielectrically un-impeded pulsed discharge inside the discharge chamber (3), characterized in that additionally a dielectrically impeded discharge is generated inside the discharge chamber (3) and thereby the spectral distribution of the radiation emitted by the discharge lamp (12;19;23) is influenced and the level of the voltage pulses required for the dielectrically un-impeded pulsed discharge is reduced so that the required level is lower with additional, dielectrically impeded discharge than without additional dielectrically impeded discharge, with a hermetically sealed discharge chamber (3) containing an ionizable filling and having in its interior two opposing unheated galvanic electrodes (5,6) connected to electrical leads (7,8), whereby the leads (7,8) extend in gas-tight manner through the ends of the discharge chamber (3) to the exterior, the discharge chamber (3) being additionally equipped with at least one dielectric electrode (13,14;17,18;24).

11. Discharge lamp according to claim 10, characterized in that the dielectric electrode(s) (13,14) is/are conductively connected to the electrical leads (7,8) of the galvanic electrodes (13,14).

12. Discharge lamp according to claim 10, characterized in that the discharge chamber (3) is tube-shaped and that the dielectric electrode(s) (13,14;17,18;24) is/are composed of at least one metal strip, whereby the metal strip(s) (13,14;17,18;24) is/are aligned essentially parallel to the longitudinal axis of the discharge chamber (3).

13. Discharge lamp according to claim 12, characterized in that the metal strip(s) (13,14;17,18;24) are applied on at least a part of the exterior wall of the discharge chamber (3) or protrude into the exterior wall or are imbedded in the exterior wall of the discharge chamber.

14. Discharge lamp according to claim 12, characterized in that two metal strips (13,14;17,18), which function as dielectric electrodes, are positioned diametrically opposite each other.

15. Discharge lamp according to claim 12, characterized in that the relationship of the respective width(s) of the metal strip(s) (13,14;17,18) to the circumference of the discharge chamber is within a range of 0.01 and 0.75.

16. Discharge lamp according to claim 12, characterized in that a metal strip (24) which tapers in the direction of the longitudinal axis of the discharge chamber (3) serves as dielectrically electrode, whereby the metal strip is connected with that galvanic electrode (6) from which the tapering end faces away.

17. Discharge lamp according to claim 10, characterized in that the discharge chamber (3) comprises noble gas, specifically one or a combination of the elements neon, xenon, argon or krypton.

18. Discharge lamp according to claim 10, characterized in that the pressure of the filling is in a range between 1 kPa and 500 kPa.

19. Discharge lamp according to claim 10, characterized in that the interior wall of the discharge chamber (3) is coated with a phosphor coating (4).

20. Discharge lamp according to claim 19, characterized in that the phosphor coating comprises a phosphor of the general formula Y3Al5O12:Ce.

21. A discharge lamp comprising:

a sealed envelope having a wall with an exterior side and an interior side, the interior side defining an enclosed discharge chamber;

the discharge chamber containing an ionizable filling;

a first unheated, galvanic electrode and a second unheated galvanic electrode, each galvanic electrode being connected by respective electrical leads from the exterior and each galvanic electrode extending through the wall in a gas tight manner to be exposed to the ionizable filling contained in the enclosed discharge chamber; and at least one dielectric electrode adjacent the exterior side.

22. The lamp in claim 21, further including a second dielectric electrode adjacent the exterior side.

23. The lamp in claim 22, wherein the first galvanic electrode and the first dielectric electrode are connected in parallel.

24. The lamp in claim 22, wherein the first galvanic electrode and the second galvanic electrode are electrically coupled to a first voltage signal; and wherein the first dielectric electrode and the second dielectric electrode are electrically coupled to a second voltage supply.

25. The lamp in claim 24, wherein the first voltage signal is coordinated with respect to the second voltage signal.

* * * * *